United States Patent [19]

Nelson

[11] 4,094,360

[45] June 13, 1978

[54] SELF-LOCKING MULE SHOE

[75] Inventor: Sharon Parr Nelson, Houston, Tex.

[73] Assignee: Wilson Industries, Inc., Houston, Tex.

[21] Appl. No.: 812,062

[22] Filed: Jul. 1, 1977

[51] Int. Cl.[2] ..... E21B 41/00

[52] U.S. Cl. ..... 166/243; 166/255

[58] Field of Search ..... 166/66, 255, 117.5, 166/243

[56] References Cited

U.S. PATENT DOCUMENTS

| | | | |
|---|---|---|---|
| 1,851,319 | 3/1932 | McCoy et al. | 166/325 |
| 2,207,505 | 7/1940 | Bremner et al. | 166/66 |
| 2,246,417 | 6/1941 | Smith | 166/66 |
| 2,536,303 | 1/1951 | Miller | 175/44 |
| 3,052,309 | 9/1962 | Eastman | 166/255 |
| 3,363,703 | 1/1968 | Shewmake | 175/44 |
| 3,718,194 | 2/1973 | Hering et al. | 175/45 |

*Primary Examiner*—James A. Leppink

*Attorney, Agent, or Firm*—Arnold, White & Durkee

[57] ABSTRACT

A mule shoe having a closed key-receiving slot defined by long and short edges therein is characterized by a cam surface thereon connecting the ends of the edges of the slot. The sum of the angular distance occupied by the slot and the angular distance through which the cam surface winds about the axis of the member is equal to at least 360°. An axially directed reaction force generated by abutting contact between the cam surface and a key is converted to a torque acting to cam the mule shoe in only a predetermined angular direction.

3 Claims, 2 Drawing Figures

SELF-LOCKING MULE SHOE

BACKGROUND OF THE INVENTION

1. Field of the Invention

This invention relates to downhole well tools, and in particular, to a mule shoe having a surface adapted to cam the mule shoe in only one predetermined angular direction.

2. Description of the Prior Art

It is known in the art of orienting tools and other related downhole well apparatus to utilize a device known as a mule shoe to align or orient a member being lowered into a well bore with respect to a key member extending radially inwardly with respect to the bore casing. For example, U.S. Pat. Nos. 2,207,505 (Bremner), 2,246,417 (Smith), 1,851,319 (McCoy), 3,718,194 (Hering), 3,363,703 (Shewmake), 3,052,309 (Eastman), disclose mule shoe devices. In addition, Sperry-Sun Catalog 767 at page 5198 also discloses a mule shoe apparatus.

In the context of the above-indicated references, that is, in a directional drilling environment, it is necessary to orient a directional finding apparatus lowered into a well bore with respect to a deflecting head or drill bit already downhole. The mule shoe shown in the above-cited references disposes a double-cam face terminating in an axially extending slot. The cam faces wind about the axis of the mule shoe and meet at a point appoximately 180° from the slot.

Depending upon which of the cam surface first engages the key at the lower end of the bore, the mule shoe is subjected to a torquing force in either a right-handed or a left-handed angular direction. It is recognized that the left-hand torque imposed upon the mule shoe assembly acts in a back-off direction, or in a direction tending to un-thread the engagement between the mule shoe and the members threaded thereabove in the string dropped into the bore.

Accordingly, it is advantageous to prevent the imposition of a torquing force on the mule shoe and related assemblies which would tend to back-off the threaded engagement between the constituent parts in the string lowered into the bore.

SUMMARY OF THE INVENTION

This invention relates to a mule shoe having a cam surface thereon adapted to impose a right-hand, or locking, torque on the mule shoe and the threaded engagements between the mule shoe and other elements connected therewith. The mule shoe comprises a cylindrical member having an axially extending slot therein, the slot being defined by a portion of an elongated edge and a short edge provided within the cylindrical member. The circumferential dimension of the slot occupies a first predetermined angular distance. A camming surface, most conveniently a helical spiral, connects the ends of the axial edges which cooperate to define the slot. The camming surface winds about the axis of the mule shoe for a second predetermined angular distance such that the sum of the first and second angular distances equals at least 360°. Axially directed reaction forces imposed on the mule shoe and generated by abutting engagement between the mule shoe and a key are converted into a torque force acting in only one predetermined angular direction with respect to the axis of the mule shoe. That is, engagement between the cam surface and the key converts an axially directed reaction force generated by that engagement into an angularly directed torque acting on the member in only one predetermined angular direction tending to threadedly engage the member to other elements.

BRIEF DESCRIPTION OF THE DRAWINGS

The invention will be more fully understood from the following detailed description thereof, taken in connection with the accompanying drawings, which form a part of this specification, and in which.

DESCRIPTION OF THE PREFERRED EMBODIMENT

Figure 1:
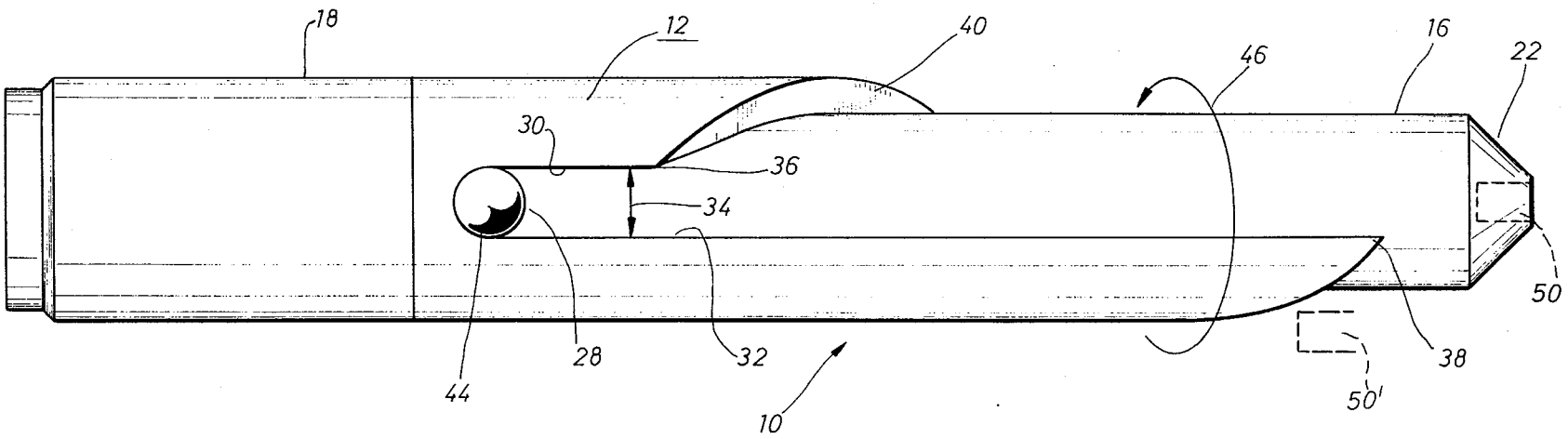
FIG. 1 is an elevational view of a mule shoe embodying the teachings of this invention; and, FIG. 2 is a section view taken through the mule shoe shown in FIG. 1 after rotation thereof 90°.

Throughout the following description similar reference numerals refer to similar elements in all figures of the drawings.

Shown in the figures is a mule shoe indicated by reference numeral 10 embodying the teachings of this invention. The mule shoe 10 has an axis extending therethrough and includes a substantially tubular cylindrical member 12 fixedly attached, as by pins 14A and 14B to a solid axially extending stinger 16. The stinger 16 includes a radially distended portion 18 thereof which terminates in a threaded connection 20 whereby the stinger 16 having a mule shoe thereon may be threadedly engaged to an adjacent element to define an axially elongated tool for lowering into the well bore. As is appreciated by those with skill in the art, the threaded connection between the threads 20 in the stinger 16 with the next-adjacent threaded member is effectuated by right-hand torquing movement of the axially adjacent members. The stinger 16, primarily provided for guidance as the mule shoe is lowered into the bore, may terminate in a truncated cone end point 22. A substantially radially extending bore 24 is provided within the stinger 16.

The cylindrical member 12 attached to the stinger 16 is provided with an opening 26 therein which, in the attached condition, registers with the bore 24 provided in the stinger, for purposes which will be discussed more fully herein.

The cylindrical member 12 has a closed key-receiving slot 28 defined therein by the cooperative association of first and second axially extending edges 30 and 32. The axially extended edges 30 and 32 are spaced angularly a predetermined distance 34 from each other, the angular distance 34 corresponding to the circumferential dimension of the slot 28. As seen in FIG. 1, the edge 32 is axially elongated with respect to the shorter edge 30. The end 36 of the short edge 30 and the end 38 of the elongated edge 32 are connected by a cam surface 40.

The cam surface 40 winds about the axis of the mule shoe 10 for a second angular distance measured angularly between the ends of the edges 36 and 38. In accordance with this invention, the sum of the first angular distance 34 (related to the dimension of the slot 28) and the second angular distance defined by the cam surface 40 is equal to at least 360° for purposes which are described more fully herein. The cam surface 40 most preferably defines a helical spiral perimetrically disposed about the cylindrical member 12.

Figure 2:
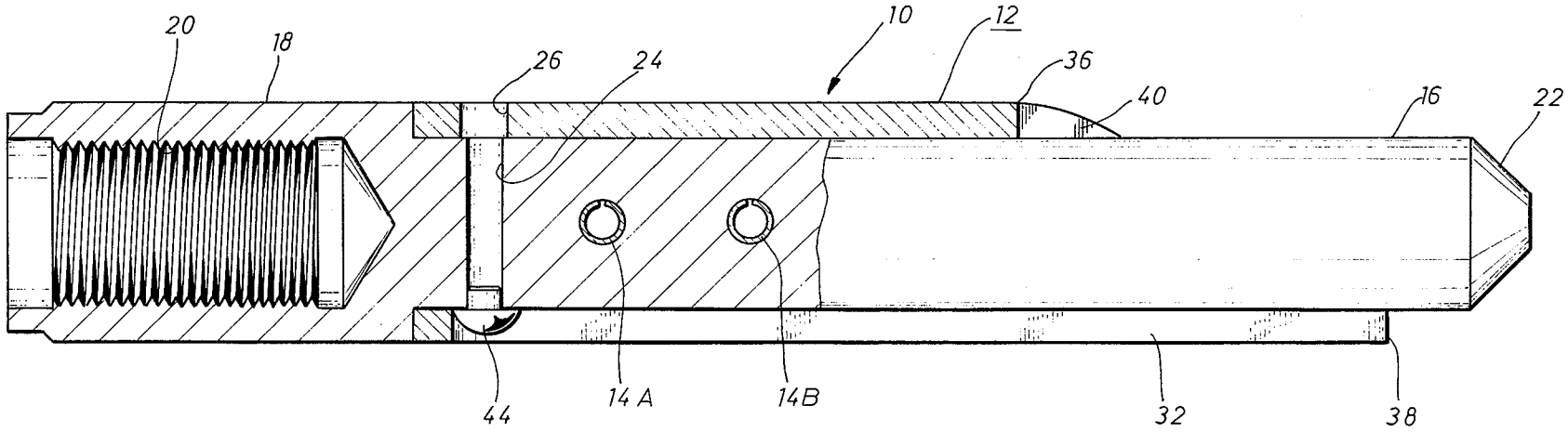

It is understood by those with skill in the art, the mule shoe 10 described above may be alternatively fabricated from integral stock by the provision of the axially extending slot 28 defined by the short edge 30 and the long edge 32. Disposition of the cam surface 40 meeting the limitation described above (viz., that the sum of the angular distances occupied by the slot dimension 34 and the cam surface 40 equal at least 360°) may be accomplished by machining the integral stock. The embodiment shown in FIGS. 1 and 2 utilizing separate a cylindrical member 12 having the slot 28 and cam surface 40 and attaching the member 12 to a stinger 16 provides manufacturing advantages apparent to those skilled in the art.

A suitable tell-tale 44 fabricated of an easily deformable material, as brass, is disposed within the bore 24. As is discussed herein, deformation of the tell-tale 44 acts as a positive indication that the slot 28 has been seated affirmatively upon a radially protruding key member usually disposed in a radially fixed downhole location within the well bore. The spent tell-tale 44 is removable through the insertion of a suitable tool within the registered openings 24 and 26.

As appreciated by those with skill in the orientation and directional drilling arts, it is especially useful to locate a direction-indicating instrument in axial alignment with a deflecting tool or deflecting drill bit. Usually, the deflecting bit is provided with a radially inwardly extending key member. To ascertain the angular orientation of the bit, a direction indicating instrument assembly is introduced into the borehole. Usually, the axially lowermost constituent element of the direction instrument assembly is the mule shoe. It is also the usual practice to drop the directional instrument assembly into the borehole. If the bore deviates from vertical to the extent that gravity is not sufficient, the directional instrument assembly is "pumped down" the borehole by operating mud circulating pumps. As discussed above, abutting engagement between the cam surface on prior art mule shoes and the key generates either a right-handed or left-handed torquing force on the mule shoe dependent upon which portion of the cam surface first engages the key. A left-handed torquing force is deleterious in that it acts in a direction tending to back-off the threaded engagement between adjacent elements connected together.

Accordingly, this invention provides a mule shoe whereby the axially directed forces generated by abutting engagement between the cam surface 40 and the key on the deflecting tool are converted to a torquing force acting in only one predetermined angular direction. In particular, due to the orientation of the cam surface 40, only right-handed torque indicated by reference arrow 46 (that is, tending to threadedly engage adjacent axial elements) is generated by abutment between the cam surface and the key.

In operation, utilizing a mule shoe 10 embodying this invention having the sum of the angular dimension of the slot 28 and the angular dimension of the surface 40 equal at least 360°, if it should occur that the mule shoe slot 28 having the circumferential dimension 34 therein is lowered into the borehole so that it fortuitously aligns axially with the key (shown at 50 in dot-dash lines), the key 50 avoids any abutting engagement with the cam surface 40 and directly enters into the slot 28. Affirmative seating engagement between the key 50 and the slot results in deformation of the tell-tale 44.

In the alternative, if the cam surface 40 engages the key 50 at any intermediate point along the surface thereof, as illustrated at 50' in dot-dash lines, the axially directed reaction force generated by the abutting contact between the key 50' and the cam surface 40 is converted into a torque acting only in a predetermined angular direction 46 tending to prevent back-off of the threaded engagement between threadedly connected elements.

It is of critical importance that the sum of the angular dimension of the cam surface and the angular dimension occupied by the slot 28 equal at least an angular distance of 360°. Any angular sum less than 360° exposes a portion of the cam surface to abutting contact with the key so as to generate a torquing movement in a direction opposite the predetermined direction 46. Accordingly, only a mule shoe wherein the summation of the angular distance subtended by the cam surface 40 plus the angular distance defined by the circumferential dimension 34 of the opening of the slot 28 is equal to or greater than 360° will abutting contact between the cam surface 40 and the key generate torque forces acting only in the predetermined angular direction 46.

Having described a preferred embodiment of the invention it is appreciated that modifications in size, shape and materials, as well as in details of the illustrated construction may be made by those skilled in the art in view of the teachings of this application and remain within the scope of the invention as defined in the appended claims.

What is claimed is:

1. A mule shoe comprising:

a member having an axis therethrough and having a long and short axially extending edge therein, said edges being spaced angularly from each other for a first predetermined angular distance and cooperating to define a key-receiving slot therebetween;

a cam surface disposed between the ends of said long and short edges, said cam surface winding about the axis of the member for a second angular distance such that the sum of said first and said second angular distances is equal to at least 360° such that an axially directed reaction force imposed on said cam surface by abutting engagement with a key imposes a torque on said member in a predetermined direction.

2. The mule shoe according to claim 1 wherein said cam surface is a helical spiral.

3. A mule shoe comprising:

a cylindrical member having an axial end point defining the origin of a helical spiral communicating at its opposite axial end point in a key-receiving slot, said spiral extending about the axis of said member for a first angular distance and said slot having a circumferential dimension equal to a second angular distance such that the sum of said first and said second angular distance is equal to at least 360°, said spiral defining a cam surface thereon such that an axially directed reaction force generated by abutment between a key and any intermediate point on said cam surface is converted into a torque tending to rotate said cylindrical member in a first predetermined direction.

* * * * *